US008454333B2

(12) United States Patent
Sotojima et al.

(10) Patent No.: US 8,454,333 B2
(45) Date of Patent: Jun. 4, 2013

(54) ROTARY FLUID MACHINE HAVING OUTER AND INNER CYLINDER CHAMBERS WITH DIFFERENT HEIGHTS

(75) Inventors: Takazou Sotojima, Sakai (JP); Yoshitaka Shibamoto, Sakai (JP); Takashi Shimizu, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 520 days.

(21) Appl. No.: 12/680,288

(22) PCT Filed: Sep. 26, 2008

(86) PCT No.: PCT/JP2008/002681
§ 371 (c)(1),
(2), (4) Date: Mar. 26, 2010

(87) PCT Pub. No.: WO2009/041056
PCT Pub. Date: Apr. 2, 2009

(65) Prior Publication Data

US 2010/0233008 A1 Sep. 16, 2010

(30) Foreign Application Priority Data

Sep. 28, 2007 (JP) ..... 2007-255708

(51) Int. Cl.
*F03C 2/00* (2006.01)
*F04C 18/00* (2006.01)
*F04C 2/00* (2006.01)

(52) U.S. Cl.
USPC ..... 418/59

(58) Field of Classification Search
USPC ..... 418/57–59
See application file for complete search history.

(56) References Cited

U.S. PATENT DOCUMENTS 502,043 A * 7/1893 Johnson ..... 418/59

FOREIGN PATENT DOCUMENTS

| | | | |
|---|---|---|---|
| JP | 62-102801 | U | 6/1987 |
| JP | 2006-207559 | A | 8/2006 |
| JP | 2007-162555 | A | 6/2007 |
| WO | WO-2008/105090 | A1 | 9/2008 |

* cited by examiner

*Primary Examiner* — Theresa Trieu
(74) *Attorney, Agent, or Firm* — Global IP Counselors

(57) ABSTRACT

A rotary fluid machine includes a cylinder with an annular cylinder chamber, an annular piston and a blade. The annular piston is disposed in the cylinder chamber so as to be eccentric to the cylinder. The annular piston divides the cylinder chamber into an outer cylinder chamber and an inner cylinder chamber. The blade is arranged in the cylinder chambers to divide each of the outer and inner cylinder chambers into a high-pressure chamber and a low-pressure chamber. The cylinder and the piston are arranged to eccentrically move relative to each other. A height of the outer cylinder chamber is different from a height of the inner cylinder chamber as measured in a direction of a rotational axis of the rotary fluid machine.

15 Claims, 8 Drawing Sheets

(a)

(b)

(a)

(b)

ROTARY FLUID MACHINE HAVING OUTER AND INNER CYLINDER CHAMBERS WITH DIFFERENT HEIGHTS

CROSS-REFERENCE TO RELATED APPLICATIONS

This U.S. National stage application claims priority under 35 U.S.C. §119(a) to Japanese Patent Application No. 2007-255708, filed in Japan on Sep. 28, 2007, the entire contents of which are hereby incorporated herein by reference.

TECHNICAL FIELD

The present invention relates to a rotary fluid machine in which fluid chambers are defined on inner and outer sides of an annular piston in an annular cylinder chamber.

BACKGROUND ART

Conventionally, rotary fluid machines are known. In such a rotary fluid machine, a cylinder with an annular cylinder chamber, and an annular piston arranged in the cylinder chamber eccentrically rotate relative to each other. In the rotary fluid machine, the annular cylinder chamber is divided into inner and outer chambers by the annular piston, and each of such chambers serves as a fluid chamber in which fluid is compressed or expanded. Further, each of the fluid chambers is divided into low-pressure and high-pressure chambers by a blade arranged in the cylinder chamber. The rotary fluid machine is used, e.g., as a compressor for compressing refrigerant circulating in a refrigerant circuit.

Japanese Patent Publication No. 2007-162555 discloses a rotary compressor as the rotary fluid machine of this type. In such a rotary compressor, an annular cylinder chamber is formed between outer and inner cylinders constituting a cylinder. The cylinder chamber is divided into outer and inner cylinder chambers by an annular piston, and each of the cylinder chambers is divided into high-pressure and low-pressure chambers by a blade. The annular piston is formed in a C-shape, i.e., a part of the annular ring splits, and swing bushes for connecting between the annular piston and the blade are provided at the split portion of the annular piston. The blade is formed separately from the cylinder in a rectangular flat shape. The blade is arranged so as to extend from the outer cylinder to the inner cylinder in a radial direction of the cylinder chamber at the split portion of the annular piston with the blade being detachably engaged in a blade groove formed in the cylinder. When eccentrically rotating the cylinder or the annular piston by a drive shaft, fluid is sucked into a low-pressure chamber side of each cylinder chamber, and then such fluid is compressed to be discharged from a high-pressure chamber side.

SUMMARY

Technical Problem

It is known that, in the rotary fluid machine of this type, the capacity of the outer cylinder chamber is larger than that of the inner cylinder chamber, and typically a capacity ratio of the cylinder chambers cannot be freely set.

In the rotary fluid machine, since an eccentrically-rotating member is eccentric to a shaft center, a torque variation is caused as illustrated in FIG. 8. One discharge is completed in each of the inner and outer cylinder chambers during one revolution of the drive shaft, and therefore the torque variation has two peaks which are 180° out of phase with each other during one revolution of the drive shaft. The capacities of the inner and outer cylinder chambers are different from each other, and the capacity ratio of such cylinder chambers cannot be freely set. Thus, as indicated by a line B in FIG. 8, there is a problem in which a difference is caused between peak values of the torque variation, resulting in vibration.

The present invention has been made in view of the foregoing, and it is an object of the present invention to adjust the capacity ratio of the inner cylinder chamber to the outer cylinder chamber.

Solution to the Problem

In order to achieve the foregoing object, in the rotary fluid machine of the present invention, a height (H1) of an outer cylinder chamber (60) in an axial direction is different from a height (H2) of an inner cylinder chamber (65), thereby adjusting a capacity ratio of the outer cylinder chamber (60) to the inner cylinder chamber (65).

Specifically, a first aspect of the invention is intended for a rotary fluid machine including a cylinder (35) with an annular cylinder chamber (60, 65); an annular piston (40) which is accommodated in the cylinder chamber (60, 65) so as to be eccentric to the cylinder (35), and which divides the cylinder chamber (60, 65) into the outer cylinder chamber (60) and the inner cylinder chamber (65); and a blade (45) which is arranged in the cylinder chambers (60, 65), and which divides each of the cylinder chambers (60, 65) into a high-pressure chamber (61, 66) and a low-pressure chamber (62, 67). The cylinder (35) and the piston (40) eccentrically rotate relative to each other.

The heights (H1, H2) of the outer cylinder chamber (60) and of the inner cylinder chamber (65) in the direction of rotational axis are different from each other.

If the heights (H1, H2) of the outer cylinder chamber (60) and of the inner cylinder chamber (65) are the same, a capacity (C1) of the outer cylinder chamber (60) is larger than the other. The capacity ratio of the outer cylinder chamber (60) to the inner cylinder chamber (65) cannot be changed without changing a diameter of the cylinder (35). However, in the first aspect of the invention, the heights (H1, H2) of the outer cylinder chamber (60) and of the inner cylinder chamber (65) are different from each other, thereby adjusting such a capacity ratio.

A second aspect of the invention is intended for the rotary fluid machine of the first aspect of the invention, in which a part of the piston (40) in a circumferential direction is a linear portion (46) continuously formed with the other part; the blade (45) is formed by integrating an outer blade portion (72) for dividing the outer cylinder chamber (60) with an inner blade portion (73) for dividing the inner cylinder chamber (65), and is formed with a recessed portion (74) slidably fitted on the linear portion (46) of the piston (40) between the both blade portions (72, 73); the cylinder (35) is formed with a blade groove (7) fitted on the blade (45) so as to slide the blade (45) in a radial direction; and heights (H3, H4) of the outer blade portion (72) and of the inner blade portion (73) are different from each other.

According to the foregoing structure, the blade (45) radially moves relative to the cylinder (35) by sliding in the blade groove (7), and is limited to move in a direction perpendicular to the radial direction relative to the cylinder (35). The linear portion (46) of the piston (40) is fitted on the recessed portion (74) of the blade (45), thereby radially sliding the piston (40) relative to the cylinder (35) together with the blade (45). The linear portion (46) of the piston (40) slides in the recessed portion (74), thereby sliding the piston (40) in the direction perpendicular to the radial direction relative to the cylinder (35). This allows the piston (40) to eccentrically rotate.

The outer blade portion (72) and the inner blade portion (73) of the blade (45) are integrally formed, and the heights (H3, H4) of the blade portions (72, 73) are differentiated depending on the different heights (H1, H2) of the outer cylinder chamber (60) and of the inner cylinder chamber (65). Consequently, the capacity ratio of the outer cylinder chamber (60) to the inner cylinder chamber (65) can be adjusted.

A third aspect of the invention is intended for the rotary fluid machine of the first aspect of the invention, in which the cylinder (35) includes an outer cylinder portion (38) and an inner cylinder portion (36) which are arranged so as to be concentric to each other, and the cylinder chambers (60, 65) are formed between the outer cylinder portion (38) and the inner cylinder portion (36); and heights (H5, H6) of the outer cylinder portion (38) and of the inner cylinder portion (36) are different from each other.

According to the foregoing structure, the outer cylinder chamber (60) is formed between the outer cylinder portion (38) of the cylinder (35) and the piston (40), and the inner cylinder chamber (65) is foamed between the inner cylinder portion (36) and the piston (40). The heights (H5, H6) of the cylinder portions (36, 38) are different from each other, thereby making the heights (H1, H2) of the outer cylinder chamber (60) and of the inner cylinder chamber (65) different from each other. Thus, the capacity ratio of the outer cylinder chamber (60) to the inner cylinder chamber (65) can be adjusted.

A fourth aspect of the invention is intended for the rotary fluid machine of the first aspect of the invention, in which the height (H1) of the outer cylinder chamber (60) is lower than the height (H2) of the inner cylinder chamber (65).

According to the foregoing structure, the heights (H1, H2) of the outer cylinder chamber (60) and of the inner cylinder chamber (65) are typically the same, and the capacity (C1) of the outer cylinder chamber (60) is larger than the other. The height (H1) of the outer cylinder chamber (60) is lower than the height (H2) of the inner cylinder chamber (65), thereby making the capacity (C1) of the outer cylinder chamber (60) smaller than a capacity (C2) of the inner cylinder chamber (65). Consequently, the both capacities (C1, C2) become equal, or approximately equal to each other.

A fifth aspect of the invention is intended for the rotary fluid machine of any one of the first to fourth aspects of the invention, in which the capacity (C1) of the outer cylinder chamber (60) is equal to the capacity (C2) of the inner cylinder chamber (65).

According to the foregoing structure, the both capacities (C1, C2) become equal to each other by making the heights (H1, H2) of the outer cylinder chamber (60) and of the inner cylinder chamber (65) different from each other. Consequently, a difference between peak values of torque variations corresponding to cylinder chambers (60, 65) can be reduced.

A sixth aspect of the invention is intended for the rotary fluid machine of any one of the first to fourth aspects of the invention, in which an outer surface area (A1) of an outer piston side surface (47) of the piston (40), which defines the outer cylinder chamber (60), is equal to an inner surface area (A2) of an inner piston side surface (48) of the piston (40), which defines the inner cylinder chamber (65).

A load acting on a rotating shaft of the rotary fluid machine from the piston is determined depending on a product of the surface area (A1, A2) of the piston side surface (47, 48) and a pressure. According to the foregoing structure, the outer surface area (A1) becomes equal to the inner surface area (A2), thereby acting equal loads on the rotating shaft corresponding to the cylinder chambers (60, 65). Thus, the difference between the peak values of the torque variations corresponding to the cylinder chambers (60, 65) can be reduced.

A seventh aspect of the invention is intended for the rotary fluid machine of the second aspect of the invention, in which either one of the cylinder (35) and the piston (40) is configured to eccentrically rotate; and the blade (45) serves as a rotation preventing element configured to prevent (a means for preventing) rotation of the eccentrically-rotating member.

According to the foregoing structure, the piston (40) slides in the direction perpendicular to the radial direction relative to the blade (45), and radially slides together with the blade (45). Displacement of the piston (40) in the rotational direction is limited, thereby preventing the rotation of the piston (40) by the blade (45).

Advantages of the Invention

According to the first aspect of the invention, the heights (H1, H2) of the outer cylinder chamber (60) and of the inner cylinder chamber (65) are different from each other, thereby adjusting the capacity ratio of the cylinder chambers (60, 65). Thus, advantages such as the reduction in the difference between the peak values of the torque variations corresponding to the cylinder chambers (60, 65) can be realized.

According to the second aspect of the invention, the heights (H3, H4) of the outer blade portion (72) and of the inner blade portion (73) of the blade (45) are different from each other, and the blade (45) is fitted on the blade groove (7) formed in the outer cylinder chamber (60) and the inner cylinder chamber (65) with the different heights (H1, H2). Thus, the advantage as in the first aspect of the invention can be realized.

According to the third aspect of the invention, the heights (H5, H6) of the outer cylinder portion (38) and of the inner cylinder portion (36) are different from each other, thereby making the heights (H1, H2) of the outer cylinder chamber (60) and of the inner cylinder chamber (65) different from each other. Thus, the advantages as in the foregoing aspects of the invention can be realized.

According to the fourth aspect of the invention, the height (H1) of the outer cylinder chamber (60) is lower than the height (H2) of the inner cylinder chamber (65), thereby making the capacity (C1) of the outer cylinder chamber (60) approximately equal to the capacity (C2) of the inner cylinder chamber (65). Thus, the difference between the peak values of the torque variations corresponding to the cylinder chambers (60, 65) is reduced, resulting in reduction in occurrence of vibration.

According to the fifth aspect of the invention, the heights (H1, H2) of the outer cylinder chamber (60) and of the inner cylinder chamber (65) are different from each other, resulting in the equal capacities (C1, C2). Thus, the difference between the peak values of the torque variations corresponding to the cylinder chambers (60, 65) is further reduced, resulting in reduction in occurrence of vibration.

According to the sixth aspect of the invention, the outer surface area (A1) of the outer piston side surface (47) of the piston (40) is equal to the inner surface area (A2) of the inner piston side surface (48), thereby realizing the advantage as in the fifth aspect of the invention.

According to the seventh aspect of the invention, the blade (45) is configured as the rotation preventing element (means), thereby omitting another member such as Oldham's coupling as the rotation preventing element (means). Consequently, cost reduction can be realized.

BRIEF DESCRIPTION OF THE DRAWINGS

FIG. 3(*a*) is a perspective view. FIG. 3(*b*) is a plan view.

FIG. 4(*a*) is a perspective view. FIG. 4(*b*) is a plan view.

DESCRIPTION OF EMBODIMENTS

Embodiments of the present invention will be described in detail hereinafter with reference to the drawings.

Figure 1:
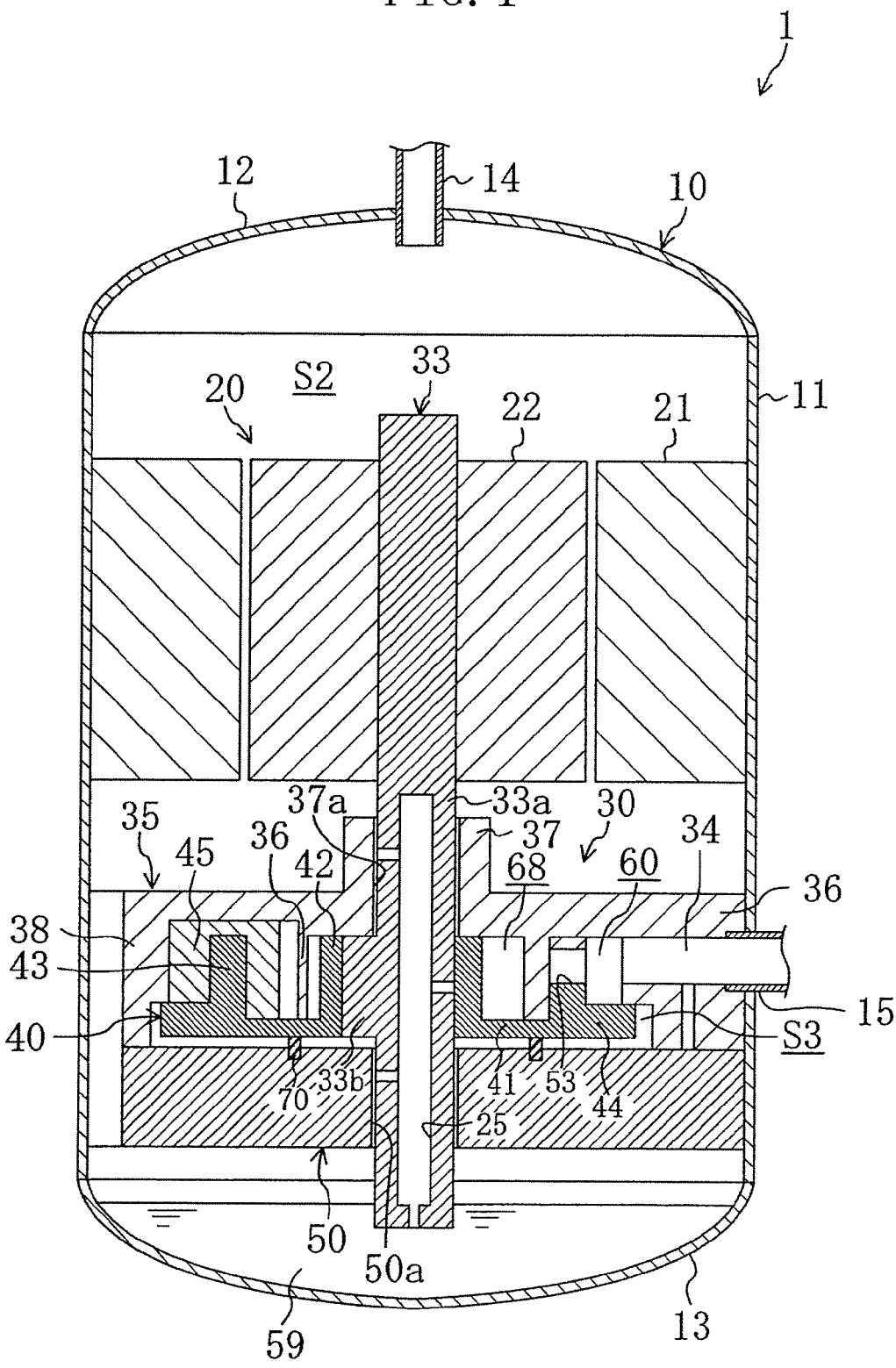
FIG. 1 is a longitudinal sectional view of a rotary compressor of an embodiment of the present invention.

As illustrated in FIG. 1, a rotary fluid machine of an embodiment is a hermetic rotary compressor (1) including a casing (10) in which an electrical motor (20) and a compression mechanism (30) are accommodated. The rotary compressor (1) is provided, e.g., in a refrigerant circuit of an air conditioner, and is used for compressing gas refrigerant sucked from an evaporator to discharge such refrigerant to a condenser.

The casing (10) is a hermetic container constituted by a body (11) formed in a vertically-elongated cylindrical shape; an upper end plate (12) fixed to an upper end portion of the body (11); and a lower end plate (13) fixed to a lower end portion of the body (11). The upper end plate (12) is provided with a discharge pipe (14) penetrating through the upper end plate (12), and a lower portion of the body (11) is provided with a suction pipe (15) penetrating through the body (11). The discharge pipe (14) communicates with the inside of the casing (10), and an inlet port thereof opens to a space above the electrical motor (20) arranged in an upper portion of the casing (10). On the other hand, the suction pipe (15) is connected to the compression mechanism (30) arranged in a lower portion of the casing (10). The rotary compressor (1) is configured so that, after refrigerant compressed in the compression mechanism (30) is discharged to an internal space of the casing (10), such refrigerant is delivered to the outside of the casing (10) through the discharge pipe (14). The inside of the casing (10) serves as a high-pressure space (S2). A bottom portion of the casing (10) serves as a storage section (59) for storing lubricating oil supplied to each sliding portion etc. of the compression mechanism (30).

A vertically-extending drive shaft (33) is arranged in the casing (10), and the compression mechanism (30) and the electrical motor (20) are drivably connected to each other through the drive shaft (33). The drive shaft (33) includes a main shaft portion (33*a*) and an eccentric portion (33*b*). At a position of the drive shaft (33) closer to the bottom, the eccentric portion (33*b*) is formed in a cylindrical shape so as to have a diameter larger than that of the main shaft portion (33*a*), and a shaft center thereof is eccentric to a shaft center of the main shaft portion (33*a*). Further, the eccentric portion (33*b*) is co-rotatably fixed to a piston (40) of the compression mechanism (30), which will be described later, with the eccentric portion (33*b*) penetrating through the piston (40).

A through-hole (25) upwardly extending from a lower end of the drive shaft (33) as an oil supply path is formed inside the drive shaft (33). This allows the lubricating oil in the storage section (59) of the casing (10) to be drawn up through the through-hole (25), and to be supplied to each sliding portion etc. of the compression mechanism (30).

The electrical motor (20) includes a stator (21) and a rotor (22). The stator (21) has a cylindrical shape, and is fixed to an inner surface of the body (11) of the casing (10). On the other hand, the main shaft portion (33*a*) of the drive shaft (33) penetrates through the rotor (22), and the rotor (22) is arranged on an inner side of the stator (21). The rotor (22) is configured so as to rotate together with the drive shaft (33).

The compression mechanism (30) includes the piston (40); a rear head (50); and a cylinder (35). The cylinder (35) is formed in a cylindrical shape with a bottom, and is arranged above the rear head (50) with its bottom being located above its opening.

Figure 2:
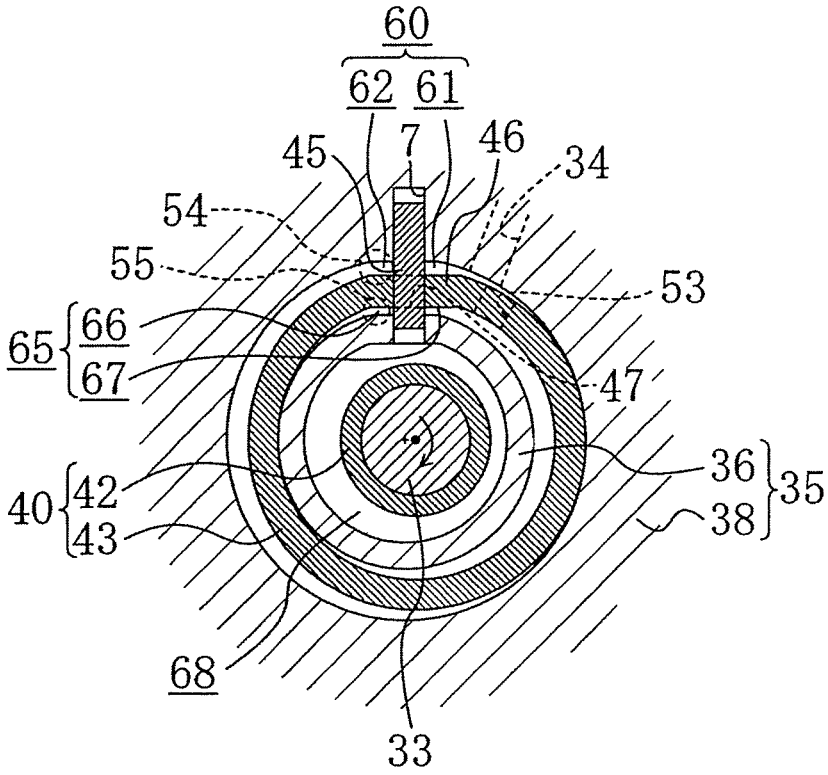
FIG. 2 is a cross-sectional view of a compression mechanism.
Figure 3:
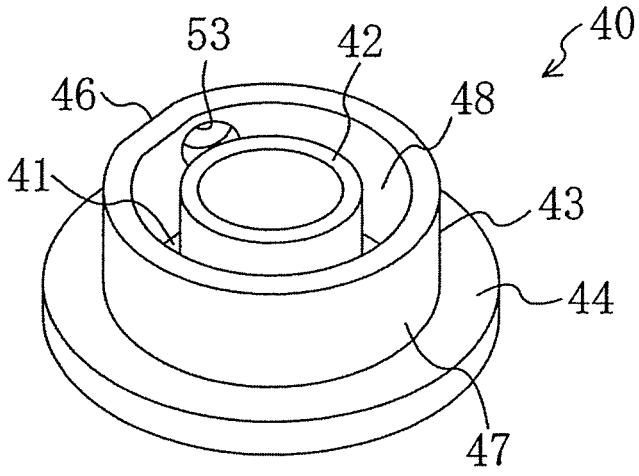
FIG. 3 illustrate a piston.
Figure 3:
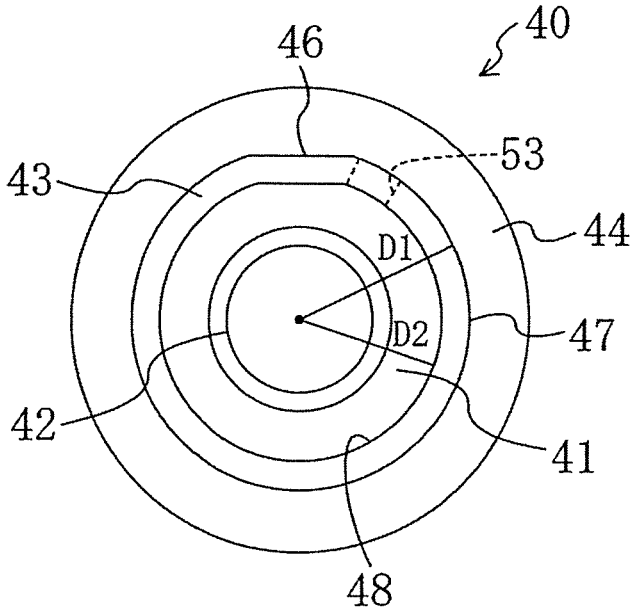

As illustrated in FIGS. 2 and 3, the piston (40) includes a cylindrical bearing (42) fitted on the eccentric portion (33*b*) of the drive shaft (33); an annular piston body (43) provided so as to be concentric to the bearing (42) with the annular piston body (43) being spaced out from the bearing (42) on an outer circumferential side thereof; a discoid inner piston-side end plate (41) provided so as to integrally connect between the bearing (42) and the annular piston body (43) on a lower end side; and an outer piston-side end plate (44) which outwardly protrudes from the lower end of the annular piston body (43) across the entire circumference, and which is provided so as to be integrally connected to the inner piston-side end plate (41).

An outer piston side surface (47) which is a side surface on an outer piston-side end plate (44) side of the annular piston body (43), and an inner piston side surface (48) which is a side surface on an inner piston-side end plate (41) side of the annular piston body (43) are concentrically-arranged cylindrical surfaces.

The annular piston body (43) is continuously formed without splitting the annular ring. A linear portion (46) linearly extending in a direction perpendicular to the radial direction is formed in a part of the annular ring of the annular piston body (43) in the circumferential direction; and a blade (45) which will be described later is slidably fitted on the linear portion (46).

Figure 6:
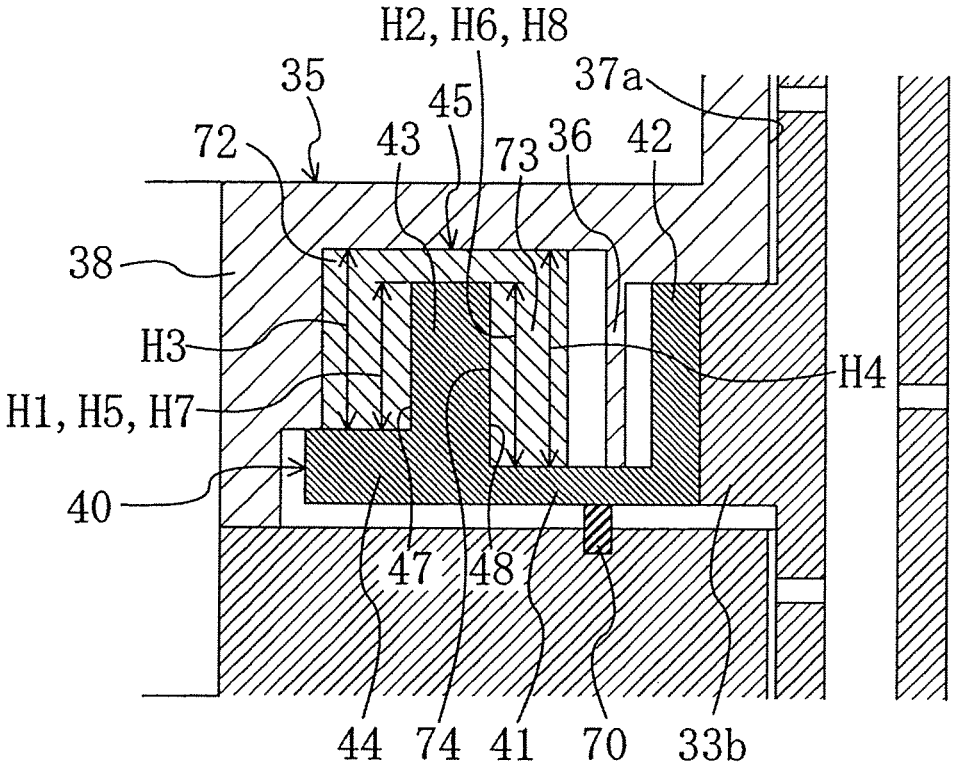
FIG. 6 is an enlarged longitudinal sectional view of the compression mechanism.

As illustrated in an enlarged view in FIG. 6, a thickness of the inner piston-side end plate (41) in a direction of rotational axis is thinner than that of the outer piston-side end plate (44) in the direction of rotational axis. Lower end surfaces of the inner piston-side end plate (41) and of the outer piston-side end plate (44) defines a continuous surface, whereas a position of an upper end surface of the inner piston-side end plate (41) is lower than a position of an upper end surface of the outer piston-side end plate (44). This allows a height (H7) of the outer piston side surface (47) in the direction of rotational axis to be lower than a height (H8) of the inner piston side surface (48) in the direction of rotational axis.

An outer surface area (A1) of the outer piston side surface (47) can be determined based on a radius (D1) which is a distance between the center of the annular piston body (43) and the outer piston side surface (47), and the height (H7) of the outer piston side surface (47) ($(A1)=2\pi\times(D1)\times(H7)$). On the other hand, an inner surface area (A2) of the inner piston side surface (48) can be determined based on a radius (D2) which is a distance between the center of the annular piston body (43) and the inner piston side surface (48), and the height (H8) of the inner piston side surface (48) ((A2)=2π×(D2)×(H8)).

A load acting on the eccentric portion (33*b*) from the piston (40) during the eccentric rotation is determined depending on a product of the surface area (A1, A2) of the piston side surface (47, 48) and a pressure. Thus, the outer surface area (A1) becomes equal to the inner surface area (A2), thereby acting the equal load on the eccentric portion (33*b*) corresponding to each of cylinder chambers (60, 65). That is, it is preferred that the height (H7) of the outer piston side surface (47) is lower than the height (H8) of the inner piston side surface (48) to set the outer surface area (A1) equal to the inner surface area (A2).

As illustrated in FIG. 1, the rear head (50) is a thick discoid member. An outer edge of the rear head (50) is fixed to an inner circumferential surface of the casing (10), and the rear head (50) is fixed so that an upper end portion thereof at an outer circumference is firmly attached to the cylinder (35). The main shaft portion (33*a*) of the drive shaft (33) penetrates through a center portion of the rear head (50), and a sliding bearing (50*a*) for rotatably supporting the main shaft portion (33*a*) is provided along an inner circumferential surface of such a through-hole.

Figure 4:
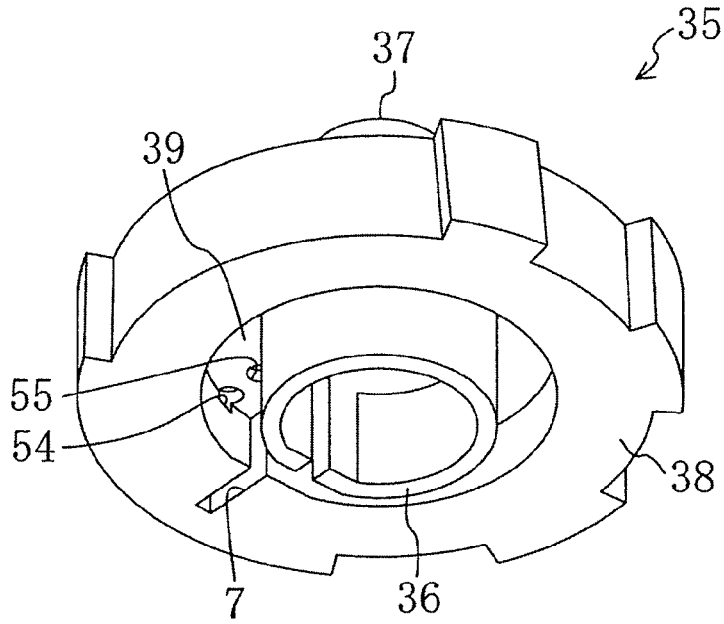
FIG. 4 illustrate a cylinder.
Figure 4:
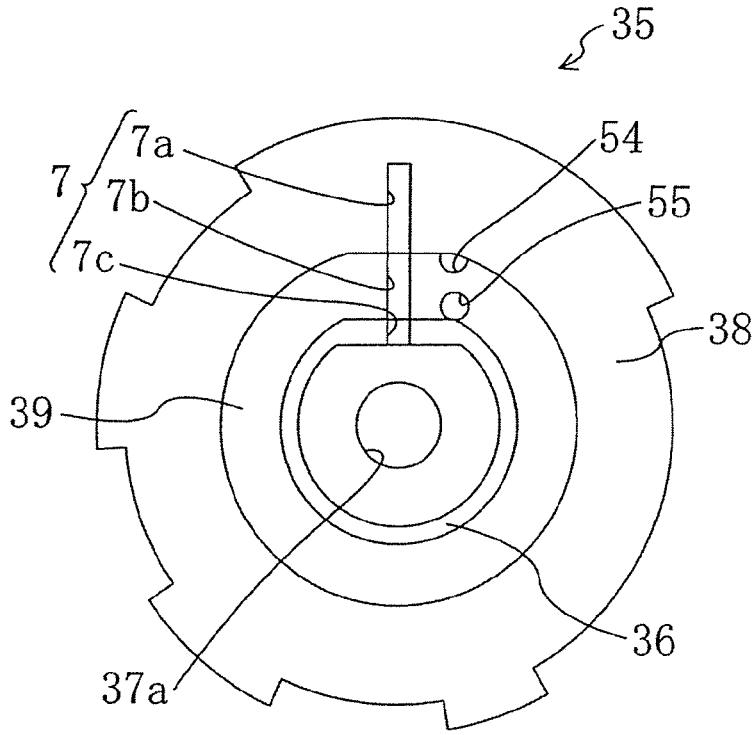

As illustrated in FIGS. 2 and 4, the cylinder (35) includes an outer cylinder portion (38) and an inner cylinder portion (36) which have an annular shape, and which are arranged so as to be concentric to each other. An inner circumferential surface of the outer cylinder portion (38) and an outer circumferential surface of the inner cylinder portion (36) are cylindrical surfaces which are arranged so as to be concentric to each other, and the annular cylinder chambers (60, 65) are formed therebetween. A portion of the inner circumferential surface of the outer cylinder portion (38) corresponding to the linear portion (46) of the annular piston body (43) is linearly formed so as to extend in the direction perpendicular to the radial direction.

The cylinder (35) further includes a thick flat plate (39) formed in a discoid shape. The outer cylinder portion (38) downwardly protrudes on an outer circumferential side of the flat plate (39), and the outer cylinder portion (38) is fixed to the inner surface of the body (11) of the casing (10) by a welding etc. The inner cylinder portion (36) protrudes from a lower surface of the flat plate (39) on an inner side of the outer cylinder portion (38), thereby forming the cylinder chambers (60, 65) as compression chambers between the inner cylinder portion (36) and the outer cylinder portion (38).

As illustrated in FIG. 2, the annular piston body (43) of the piston (40) is positioned in the cylinder chambers (60, 65). The outer piston side surface (47) of the annular piston body (43) has a diameter smaller than that of the inner circumferential surface of the outer cylinder portion (38), and the inner piston side surface (48) has a diameter larger than that of the outer circumferential surface of the inner cylinder portion (36). This forms the outer cylinder chamber (60) between the outer piston side surface (47) and the inner circumferential surface of the outer cylinder portion (38), and forms inner cylinder chamber (65) between the inner piston side surface (48) and the outer circumferential surface of the inner cylinder portion (36).

Specifically, the outer cylinder chamber (60) is defined by the flat plate (39), the outer piston-side end plate (44), the outer cylinder portion (38), and the outer piston side surface (47); and the inner cylinder chamber (65) is defined by the flat plate (39), the inner piston-side end plate (41), the inner cylinder portion (36), and the inner piston side surface (48).

An operation space (68) for allowing the bearing (42) to eccentrically rotate on an inner circumferential side of the inner cylinder portion (36) is defined by the flat plate (39) of and the inner cylinder portion (36) of the cylinder (35); and the inner piston-side end plate (41) of, and the bearing (42) of the piston (40). In the structure illustrated in FIGS. 1 and 2, the operation space (68) serves as a high-pressure space.

In the piston (40) and the cylinder (35), in a state in which the outer piston side surface (47) substantially contacts the inner circumferential surface of the outer cylinder portion (38) at one point (i.e., a state in which, even if there is a micron-order space, no disadvantage is caused due to refrigerant leakage in such a space), the inner piston side surface (48) substantially contacts the outer circumferential surface of the inner cylinder portion (36) at one point which is 180° out of phase with the above-described contact point.

An upwardly-protruding cylindrical bearing (37) is formed in the center portion of the flat plate (39) of the cylinder (35), and a sliding bearing (37*a*) is provided in the bearing (37), which is for rotatably supporting the main shaft portion (33*a*) of the drive shaft (33) with the sliding bearing (37*a*) vertically penetrating through the bearing (37).

A suction port (34) radially penetrating through the outer cylinder portion (38) is formed in the outer cylinder portion (38). One end of the suction port (34) opens to a low-pressure chamber of the outer cylinder chamber (60), whereas the other end is connected to the suction pipe (15). A through-hole (53) for communicating between a low-pressure chamber (62) of the outer cylinder chamber (60) and a low-pressure chamber (67) of the inner cylinder chamber (65) is formed in the annular piston body (43).

On the other hand, an outer discharge port (54) and an inner discharge port (55) are formed in the cylinder (35). Such discharge ports (54, 55) are formed so as to penetrate the flat plate (39) of the cylinder (35) in a thickness direction thereof. A lower end of the outer discharge port (54) opens so as to face a high-pressure chamber (61) of the outer cylinder chamber (60), and a lower end of the inner discharge port (55) opens so as to face a high-pressure chamber (66) of the inner cylinder chamber (65). A discharge valve (not shown in the figure) constituted by a check valve for opening/closing the discharge port (54, 55) is provided in the discharge port (54, 55).

A blade groove (7) on which an approximately cuboid blade (45) slidably fits is arranged along the radial direction in a position of the cylinder (35) corresponding to the linear portion (46) of the piston (40). Specifically, the blade groove (7) is constituted by a third blade groove (7*c*) formed in the inner cylinder portion (36); a second blade groove (7*b*) formed in the flat plate (39); and a first blade groove (7*a*) formed in the outer cylinder portion (38). The first to third blade grooves (7*a*, 7*b*, 7*c*) are continuously and linearly formed along the radial direction of the cylinder (35).

A portion adjacent to the third blade groove (7*c*) of the inner cylinder portion (36) is linearly formed so as to extend in the direction perpendicular to the radial direction, and the third blade groove (7*c*) is provided so as to penetrate through a center part of the linear portion of the inner cylinder portion (36) in the circumferential direction, in the thickness direction. On the other hand, the first blade groove (7*a*) is provided so as to extend to an intermediate point of the outer cylinder portion (38) between inner and outer cylindrical surfaces thereof. The blade (45) fits on the blade groove (7) to divide the cylinder chambers (60, 65) into the high-pressure chambers (61, 66) and the low-pressure chambers (62, 67) as described later.

As illustrated in FIG. 6, a height (H6) of the inner cylinder portion (36) in the direction of rotational axis is higher than a height (H5) of the outer cylinder portion (38) in the direction of rotational axis. Specifically, the height (H5) of the outer cylinder portion (38) is equal to the height (H7) of the outer piston side surface (47) of the annular piston body (43), and the height (H6) of the inner cylinder portion (36) is equal to the height (H8) of the inner piston side surface (48). Tip end surfaces (lower end surfaces) of the cylinder portions (36, 38) slidably contact the upper end surfaces of the inner piston-side end plate (41) and of the outer piston-side end plate (44) of the piston (40), which have the different thickness.

That is, the tip end surface of the outer cylinder portion (38) slidably contacts the upper end surface of the outer piston-side end plate (44), whereas the tip end surface of the inner cylinder portion (36) which is higher (longer) than the outer cylinder portion (38) slidably contacts the upper end surface of the inner piston-side end plate (41) which is positioned lower than the upper end surface of the outer piston-side end plate (44).

A tip end surface (upper end surface as viewed in FIG. 1) of the annular piston body (43) of the piston (40) slidably contacts the flat plate (39) between the inner cylinder portion (36) and the outer cylinder portion (38) of the cylinder (35), and a tip end surface of the bearing (42) of the piston (40) slidably contacts the flat plate (39) on an inner side with respect to the inner cylinder portion (36) of the cylinder (35).

This forms the hermetically-sealed cylinder chambers (60, 65) defined by the cylinder portions (36, 38) of the cylinder (35), and the piston (40). Upper ends of the outer cylinder chamber (60) and of the inner cylinder chamber (65) are positioned at the same height, and a lower end of the outer cylinder chamber (60) is positioned lower than a lower end of the inner cylinder chamber (65). That is, a height (H1) of the outer cylinder chamber (60) is equal to the height (H5) of the outer cylinder portion (38) and the height (H7) of the outer piston side surface (47), and a height (H2) of the inner cylinder chamber (65) is equal to the height (H6) of the inner cylinder portion (36) and the height (H8) of the inner piston side surface (48). In addition, the height (H1) of the outer cylinder chamber (60) is lower than the height (H2) of the inner cylinder chamber (65).

In the embodiments of the present invention, it is preferred that the piston (40) is set so that the outer surface area (A1) is equal to the inner surface area (A2) as described above; or that the heights (H1, H2) of the outer cylinder chamber (60) and of the inner cylinder chamber (65) are set so that capacities (C1, C2) are equal to each other.

Although details will be described later, a pressing force acts on the piston (40) from a rear side thereof in order to maintain the hermetic state of the cylinder chamber (60, 65).

As illustrated in FIG. 1, a seal ring (70) is provided in a position of an upper surface of the rear head (50) corresponding to a center portion of the inner piston-side end plate (41) of the piston (40). The seal ring (70) is provided so as to radially divide a space between the rear head (50) and the piston (40).

A space on an inner circumferential side with respect to the seal ring (70) communicates with the high-pressure space (S2) in the casing (10), and high-pressure lubricating oil flowing from the storage section (59) through the through-hole (25) of the drive shaft (33) is supplied thereto. That is, since the inner space with respect to the seal ring (70) is in the high-pressure state, a back pressure pushing the piston (40) to the cylinder (35) side acts on the piston (40).

A separating force which separates the piston (40) from the cylinder (35) is caused in the piston (40) due to an internal pressure of the cylinder chamber (60, 65). Meanwhile, the pressing force acts on the piston (40), thereby reducing the separation of the piston (40) from the cylinder (35). Consequently, hermeticity in the cylinder chambers (60, 65) defined by the piston (40) and the cylinder (35) can be maintained.

On the other hand, a space on an outer circumferential side with respect to the seal ring (70) serves as a back-pressure space (S3). Due to lubricating oil entering the back-pressure space (S3) through the seal ring (70), or lubricating oil leaking from the bearing through the cylinder chambers (60, 65), a pressure in the back-pressure space (S3) becomes an intermediate pressure which is higher than a pressure in the suction port (34), and which is lower than a pressure in the high-pressure space (S2) of the casing (10). This allows the pressure in the back-pressure space (S3) to act so as to push the piston (40) from the back side.

Figure 5:
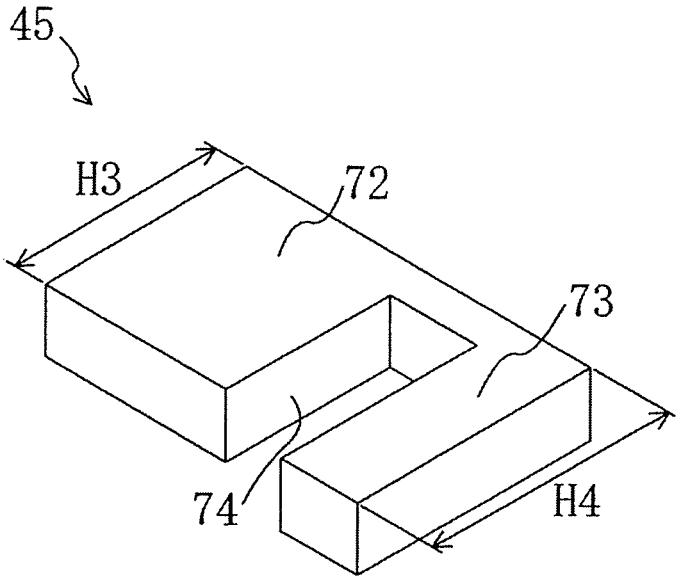
FIG. 5 is a perspective view of a blade.

The cylinder chambers (60, 65) are divided into the high-pressure chambers (61, 66) and the low-pressure chambers (62, 67) by the blade (45) which is a member formed separately from the cylinder (35). As illustrated in FIG. 5, the blade (45) is constituted by an approximately-rectangular plate-like member in which an outer blade portion (72) for dividing the outer cylinder chamber (60) are integrally formed with an inner blade portion (73) for dividing the inner cylinder chamber (65). A recessed portion (74) which is slidably fitted on the linear portion (46) of the piston (40) is formed between the both blade portions (72, 73). A length of the blade (45) in a sliding direction, i.e., a length of the cylinder (35) in the radial direction is set so as to be shorter than a length of the blade groove (7) in the radial direction, and the blade (45) fitted on the blade groove (7) radially slides in the blade groove (7).

The blade (45) is formed so that a height (H3) of the outer blade portion (72) is shorter than a height (H4) of the inner blade portion (73). Specifically, the blade (45) is formed so that, when the blade (45) is fitted on the blade groove (7) of the cylinder (35), the tip end surfaces of the outer cylinder portion (38) and of the outer blade portion (72) are flush with each other; and that the tip end surfaces of the inner cylinder portion (36) and of the inner blade portion (73) are flush with each other.

Figure 7:
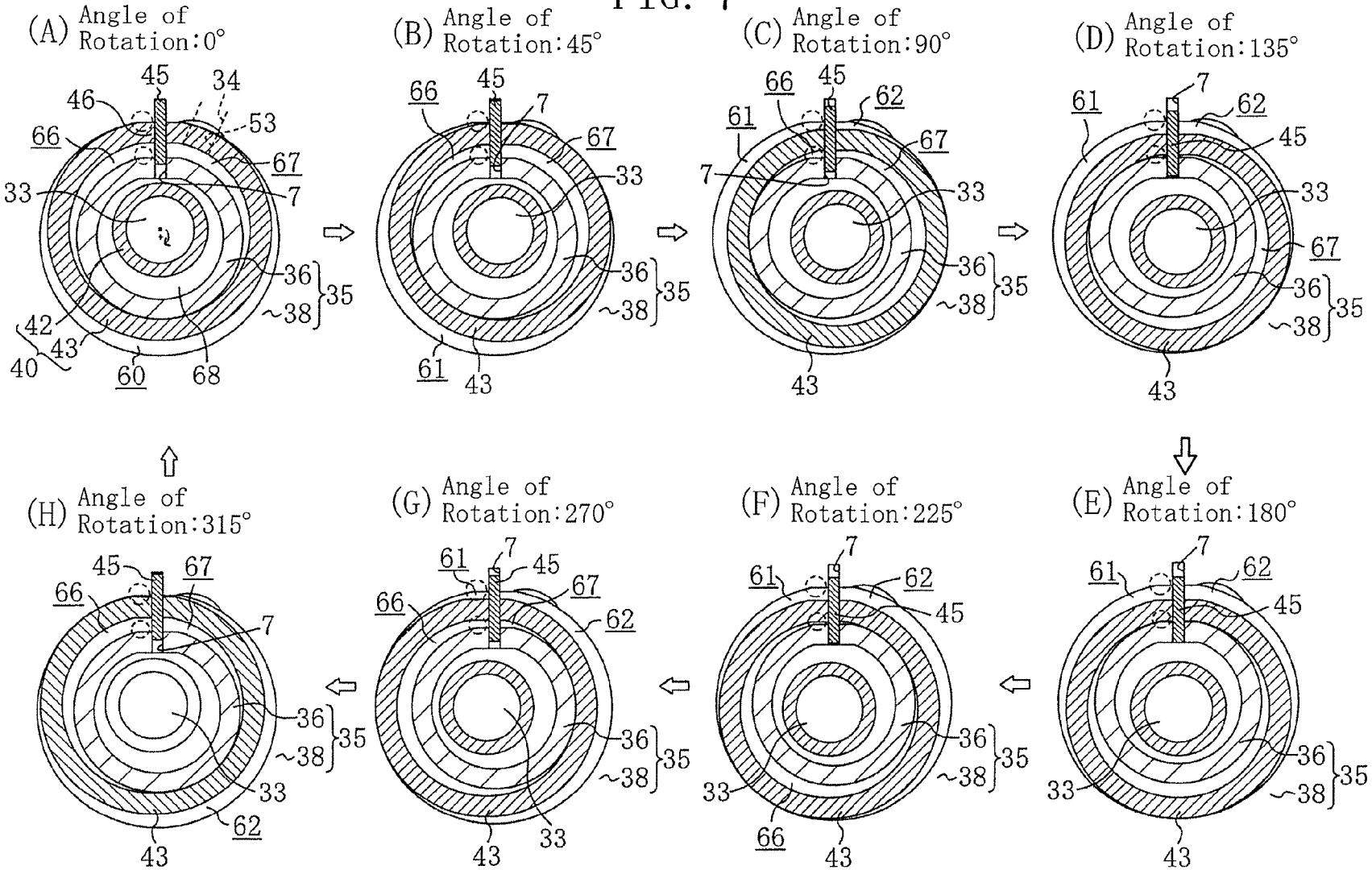
FIG. 7 are cross-sectional views illustrating operations of the compression mechanism.

In the foregoing structure, as illustrated in FIG. 7, when eccentrically rotating the piston (40) connected to the drive shaft (33) relative to the cylinder (35), the annular piston body (43) of the piston (40) eccentrically rotates while sliding the blade (45) in the radial direction of the cylinder (35) in the blade groove (7), and sliding the linear portion (46) in the direction perpendicular to the radial direction in the recessed portion (74) of the blade (45). Consequently, the annular piston body (43) revolves relative to the cylinder (35).

As described above, the annular piston body (43) slides in the radial direction of the cylinder (35) together with the blade (45), and slides in the direction perpendicular to the radial direction relative to the cylinder (35) by sliding the linear portion (46) in the recessed portion (74) of the blade (45). This allows the contact point between the annular piston body (43) and the cylinder (35) to sequentially move from a state illustrated in FIG. 7(A) to a state illustrated in FIG. 7(H), thereby compressing refrigerant in the cylinder chambers (60, 65). FIG. 7 are views illustrating operations of the compression mechanism (30) of the present embodiment, and FIGS. 7(A)-7(H) illustrate states in which the annular piston body (43) moves at 45° interval in a clockwise direction as viewed in the figures.

In the foregoing structure, the annular piston body (43) slides in the direction perpendicular to the radial direction relative to the blade (45), and slides in the radial direction together with the blade (45). Thus, displacement of the annular piston body (43) in a rotational direction thereof is limited, thereby preventing the rotation of the piston (40) by the blade (45).

(Operation)

Next, an operation of the rotary compressor (1) will be described.

When starting the electrical motor (20), the rotation of the rotor (22) is conveyed to the piston (40) of the compression mechanism (30) through the drive shaft (33). Then, the annular piston body (43) of the piston (40) reciprocates in the radial direction relative to the cylinder (35) together with the blade (45) while reciprocating the blade (45) along the blade groove (7); and the linear portion (46) of the annular piston body (43) reciprocates in the circumferential direction (direction perpendicular to the radial direction) in the recessed portion (74) of the blade (45). By combining such two movements, the annular piston body (43) revolves relative to the outer cylinder portion (38) and the inner cylinder portion (36) of the cylinder (35), thereby performing a predetermined compression operation by the compression mechanism (30).

Specifically, in the outer cylinder chamber (60) of the compression mechanism (30), the capacity of a low-pressure chamber (62) is approximately minimum in the state illustrated in FIG. 7(B). Starting from such a state, while the capacity of the low-pressure chamber (62) increases as the state illustrated in FIG. 7(C) is sequentially changed to the state illustrated in FIG. 7(A) by rotating the drive shaft (33) clockwise as viewed in the figure, refrigerant is sucked into the low-pressure chamber (62) through the suction pipe (15) and the suction port (34).

When the drive shaft (33) rotates one revolution and returns to the state illustrated in FIG. 7(B), the suction of the refrigerant into the low-pressure chamber (62) is completed. The low-pressure chamber (62) is changed to a high-pressure chamber (61) in which the refrigerant is compressed, and another low-pressure chamber (62) is formed across the blade (45). When further rotating the drive shaft (33), the suction of the refrigerant is repeated in the low-pressure chamber (62), and the capacity of the high-pressure chamber (61) decreases to compress the refrigerant in the high-pressure chamber (61). When a pressure in the high-pressure chamber (61) reaches a predetermined value, and a pressure difference between the high-pressure chamber (61) and a discharge space reaches a set value, the discharge valve is opened by the high-pressure refrigerant of the high-pressure chamber (61), thereby flowing out the high-pressure refrigerant from the discharge space to the high-pressure space (S2) of the casing (10).

In the inner cylinder chamber (65), the capacity of a low-pressure chamber (67) is approximately minimum in the state illustrated in FIG. 7(F). Starting from such a state, while the capacity of the low-pressure chamber (67) increases as the state illustrated in FIG. 7(G) is sequentially changed to the state illustrated in FIG. 7(E) by rotating the drive shaft (33) clockwise as viewed in the figure, refrigerant is sucked into the low-pressure chamber (67) of the inner cylinder chamber (65) through the suction pipe (15), the suction port (34), and the through-hole (53).

When the drive shaft (33) rotates one revolution and returns to the state illustrated in FIG. 7(F), the suction of the refrigerant into the low-pressure chamber (67) is completed. The low-pressure chamber (67) is changed to a high-pressure chamber (66) in which the refrigerant is compressed, and another low-pressure chamber (67) is formed across the blade (45). When further rotating the drive shaft (33), the suction of the refrigerant is repeated in the low-pressure chamber (67), and the capacity of the high-pressure chamber (66) decreases to compress the refrigerant in the high-pressure chamber (66). When a pressure in the high-pressure chamber (66) reaches a predetermined value, and a pressure difference between the high-pressure chamber (66) and the discharge space reaches a set value, the discharge valve is opened by the high-pressure refrigerant of the high-pressure chamber (66), thereby flowing out the high-pressure refrigerant from the discharge space to the high-pressure space (S2) of the casing (10).

In the outer cylinder chamber (60), the discharge of the refrigerant is started at a timing at which the compression mechanism is approximately in the state illustrated in FIG. 7(E); and, in the inner cylinder chamber (65), the discharge is started at a timing at which the compression mechanism is approximately in the state illustrated in FIG. 7(A). That is, the outer cylinder chamber (60) and the inner cylinder chamber (65) differ from each other in the discharge timing by approximately 180°. The high-pressure refrigerant which is compressed in the outer cylinder chamber (60) and the inner cylinder chamber (65) to flow out to the high-pressure space (S2) of the casing (10) is discharged through the discharge pipe (14), and then such refrigerant is sucked into the rotary compressor (1) again after condensation, expansion, and evaporation strokes in the refrigerant circuit.

The inner space formed by dividing the space between the piston (40) and the rear head (50) by the seal ring (70) communicates with the high-pressure space (S2), resulting in the inner space being in the high-pressure state. Thus, the piston (40) is pushed from the back side thereof to the cylinder (35) side.

Meanwhile, the lubricating oil in the storage section (59) is drawn up through the through-hole (25) of the drive shaft (33) by a centrifugal pumping action at the lower end of the drive shaft (33), and then such lubricating oil is supplied to the sliding bearings (37*a*, 50*a*) of the compression mechanism (30), and to the space between the piston (40) and the rear head (50) on the inner circumferential side with respect to the seal ring (70).

If a difference between the pressure in the back-pressure space (S3) and a suction pressure is large, the discharge valve is opened to discharge the lubricating oil to the suction port (34) through an oil discharge path. The lubricating oil discharged to the suction port (34) as described above is sucked into the compression mechanism (30) together with the refrigerant, and is compressed in the cylinder chambers (60, 65). Subsequently, such lubricating oil is discharged to the high-pressure space (S2) of the casing (10) to return to the storage section (59).

Advantages of Embodiment

Figure 8:
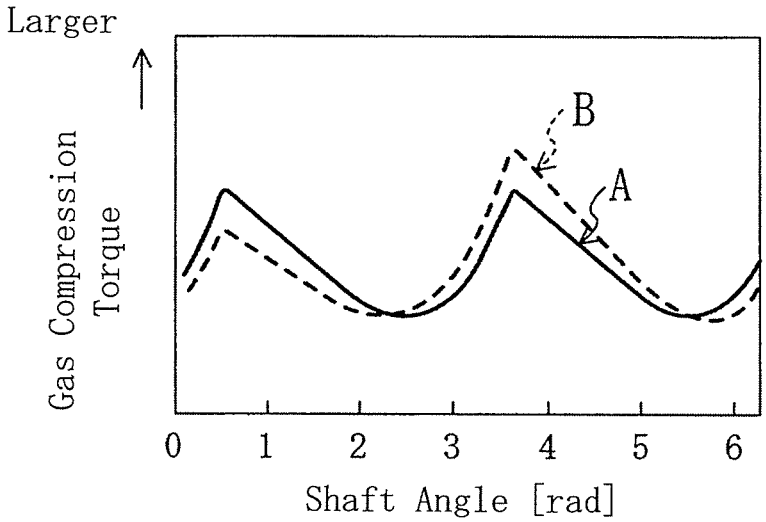
FIG. 8 is a plot illustrating characteristics of torque variations in the embodiment of the present invention and in a conventional example.

Thus, in the rotary compressor (1) of the present embodiment, the height (H3) of the outer blade portion (72) is lower than the height (H4) of the inner blade portion (73); and the height (H5) of the outer cylinder portion (38), and the height (H7) of the outer piston side surface (47) are lower than the height (H6) of the inner cylinder portion (36), and the height (H8) of the inner piston side surface (48), thereby making the height (H1) of the outer cylinder chamber (60) lower than the height (H2) of the inner cylinder chamber (65). In addition, the capacity (C1) of the outer cylinder chamber (60) is equal to the capacity (C2) of the inner cylinder chamber (65), or the outer surface area (A1) of the outer piston side surface (47) is equal to the inner surface area (A2) of the inner piston side surface (48), thereby acting the equal load on the eccentric portion (33*b*) corresponding to the cylinder chambers (60, 65). That is, as indicated by a line A in FIG. 8, there is almost no difference in torque immediately before the refrigerant is discharged, in the cylinder chambers (60, 65), thereby reducing a difference between peak values of the torque variations corresponding to the cylinder chambers (60, 65). Consequently, vibration can be reduced.

The blade (45) radially slides relative to the cylinder (35) by sliding in the blade groove (7), and is limited to move in the direction perpendicular to the radial direction relative to the cylinder (35). The linear portion (46) is fitted on the recessed portion (74) of the blade (45), thereby radially sliding the piston (40) relative to the cylinder (35) together with blade (45). In addition, the linear portion (46) of the piston (40) slides in the recessed portion (74), thereby sliding in the direction perpendicular to the radial direction relative to the cylinder (35). This allows the piston (40) to eccentrically rotate.

The piston (40) slides in the direction perpendicular to the radial direction relative to the blade (45), and radially slides together with the blade (45). Thus, the displacement of the piston (40) in the rotational direction thereof is limited, thereby preventing the rotation of the piston (40) by the blade (45). The blade (45) is configured as a rotation preventing element (means as described above, thereby omitting another member such as Oldham's coupling as the rotation preventing element (means). Consequently, cost reduction can be realized.

Other Embodiments

The foregoing embodiment has been set forth merely for purposes of examples in nature, and the present invention is not limited to such an example. For example, the present invention may have the following structures.

That is, in the foregoing embodiment, the height (H1) of the outer cylinder chamber (60) is lower than the height (H2) of the inner cylinder chamber (65), and the capacities (C1, C2) of the outer cylinder chamber (60) and of the inner cylinder chamber (65) become equal to each other. However, it is not necessary to set the capacities (C1, C2) of the cylinder chambers (60, 65) equal to each other, and, e.g., the height (H1) of the outer cylinder chamber (60) may be lower than the height (H2) of the inner cylinder chamber (65), thereby reducing the difference between the both capacities (C1, C2).

In the present invention, the height (H1) of the outer cylinder chamber (60) is not necessarily lower than the height (H2) of the inner cylinder chamber (65). The heights (H1, H2) of the outer cylinder chamber (60) and of the inner cylinder chamber (65) may be differentiated, thereby adjusting a capacity ratio of the both cylinder chambers.

In the foregoing embodiment, the height (H7) of the outer piston side surface (47) of the annular piston body (43) is lower than the height (H8) of the inner piston side surface (48), and the outer surface area (A1) and the inner surface area (A2) become equal to each other. However, the both surface areas (A1, A2) are not necessarily to be equal to each other as long as the difference between the both surface areas (A1, A2) can be reduced.

In the foregoing embodiment, the drive shaft (33) is connected to the piston (40) to rotate the annular piston body (43), but it is not limited to the above. By providing the annular piston body (43) in the fixed cylinder (35), and providing the outer cylinder portion (38) and the inner cylinder portion (36) in the rotatable piston (40), the outer cylinder portion (38) and the inner cylinder portion (36) may be rotated. In such a case, the blade (45) is configured so as to be slidable in the extending direction and the direction perpendicular thereto between the outer cylinder portion (38) and the inner cylinder portion (36).

In the foregoing embodiment, the rotary compressor (1) is described as the fluid machine of the present invention. However, the present invention may be also applied to an expander in which gas such as high-pressure refrigerant is injected to a cylinder chamber, and a drive force of a rotating shaft is generated by expanding such gas, and may be applied to a pump.

In the foregoing embodiment, the electrical motor (20) is accommodated in the casing (10), but it is not limited to the above. The compression mechanism (30) may be driven from outside the casing (10).

INDUSTRIAL APPLICABILITY

As described above, the present invention is useful for a rotary fluid machine in which fluid chambers are defined on inner and outer sides of an annular piston in an annular cylinder chamber.

What is claimed is:

1. A rotary fluid machine, comprising:

a cylinder with an annular cylinder chamber;

an annular piston disposed in the cylinder chamber so as to be eccentric to the cylinder, the annular piston dividing the cylinder chamber into an outer cylinder chamber and an inner cylinder chamber, an outer surface of the piston defining an inner periphery of the outer cylinder chamber and an inner surface of the piston defining an outer periphery of the inner cylinder chamber; and a blade arranged in the cylinder chambers to divide each of the outer and inner cylinder chambers into a high-pressure chamber and a low-pressure chamber, the cylinder and the piston being arranged to eccentrically move relative to each other, a height of the outer cylinder chamber is different from a height of the inner cylinder chamber as measured in a direction of a rotational axis of the rotary fluid machine, and the annular piston extending axially from an end plate to a common axial location on the inner and outer surfaces thereof defining outer and inner peripheries of the inner and outer cylinder chambers, and the end plate having different axial thicknesses radially outward and inward of the annular piston to define the different heights of the outer and inner cylinder chambers.

2. The rotary fluid machine of claim 1, wherein the cylinder includes an outer cylinder portion and an inner cylinder portion are arranged so as to be concentric relative to each other, and the outer and inner cylinder chambers are formed between the outer cylinder portion and the inner cylinder portion; and a height of the outer cylinder portion is different from a height of the inner cylinder portion as measured along the direction of the rotational axis.

3. The rotary fluid machine of claim 2, wherein a capacity of the outer cylinder chamber is equal to a capacity of the inner cylinder chamber.

4. The rotary fluid machine of claim 2, wherein an outer surface area of an outer piston side surface of the piston is equal to an inner surface area of an inner piston side surface of the piston, the outer piston side surface defines part of the outer cylinder chamber, and the inner piston side surface defines part of the inner cylinder chamber.

5. A rotary fluid machine comprising:
a cylinder with an annular cylinder chamber;
an annular piston disposed in the cylinder chamber so as to be eccentric to the cylinder the annular piston dividing the cylinder chamber into an outer cylinder chamber and an inner cylinder chamber; and
a blade arranged in the cylinder chambers to divide each of the outer and inner cylinder chambers into a pressure chamber and a low-pressure chamber,
the cylinder and the piston being arranged to eccentrically move relative to each other,
a height of the outer cylinder chamber is different from a height of the inner cylinder chamber as measured in a direction of a rotational axis of the rotary fluid machine,
a part of the piston in a circumferential direction being a linear portion continuously formed with an other part of the piston,
the blade being formed by integrating an outer blade portion with an inner blade portion, the outer blade portion being arranged to divide the outer cylinder chamber, the inner blade portion being arranged to divide the inner cylinder chamber, and the blade including a recessed portion slidably fitted on the linear portion of the piston between the inner and outer blade portions,
the cylinder including a blade groove fitted on the blade so as to slide the blade in a radial direction, and
a height of the outer blade portion being different from a height of the inner blade portion as measured along the direction of the rotational axis.

6. The rotary fluid machine of claim 5, wherein
either one of the cylinder and the piston is configured to eccentrically move relative to the other, and
the blade serves as a rotation preventing configured to prevent rotation of the eccentrically moving cylinder or piston.

7. The rotary fluid machine of claim 5, wherein
a capacity of the outer cylinder chamber is equal to a capacity of the inner cylinder chamber.

8. The rotary fluid machine of claim 5, wherein
an outer surface area of an outer piston side surface of the piston is equal to an inner surface area of an inner piston side surface of the piston,
the outer piston side surface defines part of the outer cylinder chamber, and
the inner piston side surface defines part of the inner cylinder chamber.

9. A rotary fluid machine comprising:
a cylinder with an annular cylinder chamber;
an annular piston disposed in the cylinder chamber so as to be eccentric to the cylinder, the annular piston dividing the cylinder chamber into an outer cylinder chamber and an inner cylinder chamber; and
a blade arranged in the cylinder chambers to divide each of the outer and inner cylinder chambers into a pressure chamber and a low-pressure chamber,
the cylinder and the piston being arranged to eccentrically move relative to each other,
a height of the outer cylinder chamber is different from a height of the inner cylinder chamber as measured in a direction of a rotational axis of the rotary fluid machine, and
the height of the outer cylinder chamber being lower than the height of the inner cylinder chamber.

10. The rotary fluid machine of claim 9, wherein
a capacity of the outer cylinder chamber is equal, to a capacity of the inner cylinder chamber.

11. The rotary fluid machine of claim 9, wherein
an outer surface area of an outer piston side surface of the piston is equal to an inner surface area of an inner piston side surface of the piston,
the outer piston side surface defines part of the outer cylinder chamber, and
the inner piston side surface defines part of the inner cylinder chamber.

12. A rotary fluid machine comprising:
a cylinder with an annular cylinder chamber;
an annular piston disposed in the cylinder chamber so as to be eccentric to the cylinder, the annular piston dividing the cylinder chamber into an outer cylinder chamber and an inner cylinder chamber; and
a blade arranged in the cylinder chambers to divide each of the outer and inner cylinder chambers into a high-pressure chamber and a low-pressure chamber,
the cylinder and the piston being arranged to eccentrically move relative to each other,
a height of the outer cylinder chamber is different from a height of the inner cylinder chamber as measured in a direction of a rotational axis of the rotary fluid machine, and
a capacity of the outer cylinder chamber being equal to a capacity of the inner cylinder chamber.

13. The rotary fluid machine of claim 12, wherein
the cylinder includes an outer cylinder portion and an inner cylinder portion are arranged so as to be concentric relative to each other, and the outer and inner cylinder chambers are formed between the outer cylinder portion and the inner cylinder portion; and
a height of the outer cylinder portion is different from a height of the inner cylinder portion as measured along the direction of the rotational axis.

14. A rotary fluid machine comprising:
a cylinder with an annular cylinder chamber;
an annular piston disposed in the cylinder chamber so as to be eccentric to the cylinder, the annular piston dividing the cylinder chamber into an outer cylinder chamber and an inner cylinder chamber; and
a blade arranged in the cylinder chambers to divide each of the outer and inner cylinder chambers into a high-pressure chamber and a low-pressure chamber,
the cylinder and the piston being arranged to eccentrically move relative to each other,
a height of the outer cylinder chamber is different from a height of the inner cylinder chamber as measured in a direction of a rotational axis of the rotary fluid machine,
an outer surface area of an outer piston side surface of the piston being equal to an inner surface area of an inner piston side surface of the piston,
the outer piston side surface defining part of the outer cylinder chamber, and
the inner piston side surface defining part of the inner cylinder chamber.

15. The rotary fluid machine of claim 14, wherein
the cylinder includes an outer cylinder portion and an inner cylinder portion are arranged so as to be concentric relative to each other, and the outer and inner cylinder chambers are formed between the outer cylinder portion and the inner cylinder portion; and
a height of the outer cylinder portion is different from a height of the inner cylinder portion as measured along the direction of the rotational axis.

* * * * *